US009464780B2

(12) United States Patent
Huang et al.

(10) Patent No.: US 9,464,780 B2
(45) Date of Patent: Oct. 11, 2016

(54) LED LIGHT ENGINE FOR SIGNAGE

(71) Applicants: Michele Kun Huang, San Antonio, TX (US); Glenn Freeman, San Antonio, TX (US)

(72) Inventors: Michele Kun Huang, San Antonio, TX (US); Glenn Freeman, San Antonio, TX (US)

(73) Assignee: General LED, Inc., San Antonio, TX (US)

( * ) Notice: Subject to any disclaimer, the term of this patent is extended or adjusted under 35 U.S.C. 154(b) by 66 days.

(21) Appl. No.: 14/215,126

(22) Filed: Mar. 17, 2014

(65) Prior Publication Data

US 2014/0268818 A1 Sep. 18, 2014

Related U.S. Application Data

(60) Provisional application No. 61/793,101, filed on Mar. 15, 2013.

(51) Int. Cl.

| | |
|---|---|
| ***F21V 5/04*** | (2006.01) |
| ***G09F 13/22*** | (2006.01) |
| *F21V 31/04* | (2006.01) |
| *F21Y 101/02* | (2006.01) |

(52) U.S. Cl.

CPC .. *F21V 5/04* (2013.01); *F21S 4/10* (2016.01); *G09F 13/22* (2013.01); *F21V 31/04* (2013.01); *F21Y 2101/02* (2013.01); *Y10T 29/4913* (2015.01)

(58) Field of Classification Search

CPC ..... H05K 13/0046; F21V 5/04

See application file for complete search history.

(56) References Cited

U.S. PATENT DOCUMENTS

| | | | | |
|---|---|---|---|---|
| 5,559,681 | A | 9/1996 | Duarte | |
| 5,577,493 | A | 11/1996 | Parkyn, Jr. et al. | |
| 6,074,074 | A | 6/2000 | Marcus | |
| 6,566,824 | B2 | 5/2003 | Panagotacos et al. | |
| 6,673,292 | B1 | 1/2004 | Gustafson et al. | |
| 6,673,293 | B1 | 1/2004 | Mistopoulos et al. | |
| 6,837,598 | B2 | 1/2005 | Marcus | |
| 6,924,973 | B2 | 8/2005 | Kim | |
| 6,932,495 | B2 | 8/2005 | Sloan et al. | |
| 6,942,360 | B2 | 9/2005 | Chou et al. | |
| 7,036,962 | B2 * | 5/2006 | Chan | A44C 15/0015 362/103 |
| 7,160,140 | B1 | 1/2007 | Mrakovich et al. | |
| 7,165,863 | B1 | 1/2007 | Thomas et al. | |
| 7,241,031 | B2 | 7/2007 | Sloan et al. | |
| 7,429,186 | B2 | 9/2008 | Mrakovich et al. | |
| 7,687,288 | B2 | 3/2010 | Saha et al. | |
| 7,749,813 | B2 | 7/2010 | Kolodin et al. | |
| 7,832,896 | B2 | 11/2010 | Saha et al. | |
| 7,868,903 | B2 * | 1/2011 | Wendler | G09F 9/33 345/204 |
| 7,915,061 | B2 | 3/2011 | Nall et al. | |
| 7,926,976 | B2 | 4/2011 | Schinzel-Kolb et al. | |
| 7,926,977 | B2 | 4/2011 | Nall et al. | |

(Continued)

*Primary Examiner* — Peggy Neils
*Assistant Examiner* — Alexander Garlen
(74) *Attorney, Agent, or Firm* — William H. Quirk; Jesse L. Frizzell; Rosenthal Pauerstein Sandoloski Agather LLP

(57) ABSTRACT

A durable LED light engine includes an printed circuit board including LEDs mounted thereon positioned between a substantially U-shaped top enclosure and a bottom enclosure. Once assembled together using alignment holes and projections, the open spaces in the combination of the substantially U-shaped top enclosure, the printed circuit board and the bottom enclosure are filled with a plastic sealant. Once cooled, the plastic sealant holds the combination of the substantially U-shaped top enclosure, the printed circuit board and bottom enclosure together.

5 Claims, 6 Drawing Sheets

(56) References Cited

U.S. PATENT DOCUMENTS

| | | | | |
|---|---|---|---|---|
| 7,931,386 | B2 | 4/2011 | Nall et al. | |
| 8,083,381 | B2 * | 12/2011 | Tsai | F21V 17/164 362/249.02 |
| 2004/0075399 | A1 | 4/2004 | Hall | |
| 2006/0187668 | A1 | 8/2006 | Howe | |
| 2006/0270105 | A1 | 11/2006 | Takiar et al. | |
| 2008/0220549 | A1 * | 9/2008 | Nall | H05K 3/284 438/26 |
| 2009/0103325 | A1 | 4/2009 | Dubuc | |
| 2010/0319470 | A1 * | 12/2010 | Wehrle | H05K 3/284 73/866.1 |
| 2011/0085334 | A1 * | 4/2011 | Wang | F21S 4/001 362/249.02 |
| 2013/0049048 | A1 * | 2/2013 | Takeda | F21V 23/002 257/98 |

* cited by examiner

LED LIGHT ENGINE FOR SIGNAGE

CROSS REFERENCE TO RELATED APPLICATION

This application claims the benefit of Provisional U.S. Patent Application No. 61/793,101 filed Mar. 15, 2013.

STATEMENT REGARDING FEDERALLY FUNDED RESEARCH AND DEVELOPMENT

The invention described in this patent application was not the subject of federally sponsored research or development.

FIELD

The disclosed invention relates to a device for using light emitting diodes ("LED") to illuminate signage. More particularly, the present invention relates to a light engine which is attached to other similar light engines to form a string of light engines typically used for retail and commercial sign illumination but may be used for interior lighting, point of sale lighting, and merchandising displays.

BACKGROUND

Conventional flexible lighting systems that incorporate strings of LED light engines are typically used to provide illumination for cabinet or channel letter signs. Such strings of LED light engines are particularly useful with irregularly shaped signage. However, in irregularly shaped signage, the irregular shape of the sign makes it difficult to obtain uniform illumination. Accordingly, there remains a need in the art for a durable LED light engine that can be connected to other durable light engines to form a string of light engines that enables uniform illumination even in irregularly shaped signage.

SUMMARY

The durable LED light engine of the present invention can be connected to other durable light engines to form a string of light engines that enable uniform illumination even in irregularly shaped signage.

The LED light engine of the present invention is constructed around a printed circuit board having LEDs positioned on the top surface thereof and wires attached to electronic componentry positioned on the bottom surface thereof. Covering the printed circuit board is a substantially U-shaped top enclosure. The substantially U-shaped top enclosure has lenses formed on a top surface thereof. The opening to each lens is constructed and arranged to be positioned over an LED in the assembled LED light engine.

The underside of the substantially U-shaped top enclosure includes one or more alignment projections which pass through alignment holes in the printed circuit board. Underneath the printed circuit board is a bottom enclosure. Alignment receptacles in the bottom enclosure receive the alignment projections extending from the bottom of the substantially U-shaped top enclosure.

After the printed circuit board is placed between the substantially U-shaped top enclosure and the bottom enclosure, the combination of the substantially U-shaped top enclosure, the printed circuit board and the bottom enclosure are placed in a mold used in a plastic molding machine. A molten plastic sealant material is then injected into the combination of the substantially U-shaped top enclosure, the printed circuit board and the bottom enclosure. Once cooled, the molten plastic sealant material forms strain reliefs around and covers the insulated wires connected to the bottom of the printed circuit board as well as affixing the substantially U-shaped top enclosure, the printed circuit board and the bottom enclosure one to another.

BRIEF DESCRIPTION OF THE DRAWING FIGURES

A better understanding of the LED light engine of the present invention may be had by reference to the drawing figures wherein.

DESCRIPTION OF THE EMBODIMENTS

Figure 1:
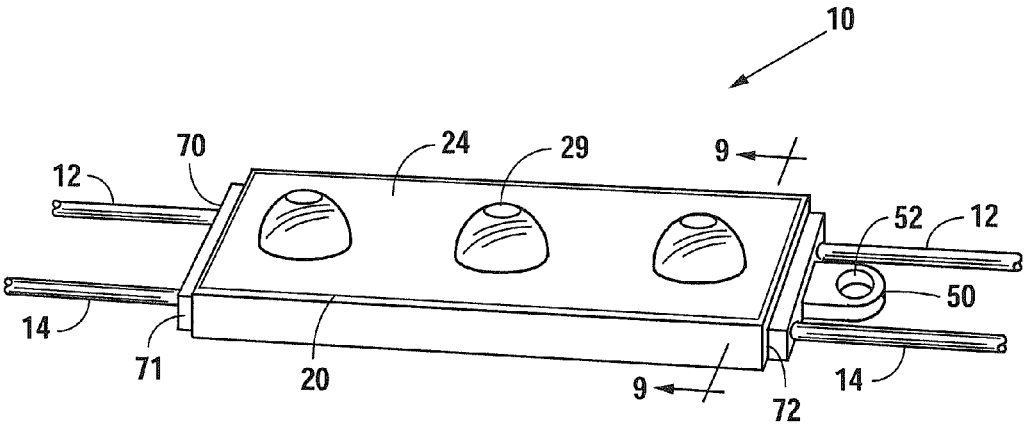
FIG. 1 is a front perspective view of a completed light engine according to the present invention.

The present invention enables a durable LED light engine 10 that may be used for illuminating signage. As shown in FIG. 1, the top of the LED light engine 10 of the present invention is a substantially U-shaped top enclosure 20. Included in the substantially U-shaped top enclosure 20 are lenses 29. These lenses 29 are located over the LEDs contained with the LED light engine 10. Extending from the ends of the LED light engine 10 are insulated wires 12, 14. These insulated wires 12, 14 both provide electrical energy to the LEDs and enable the connection of one LED light engine 10 to another. Also extending from one end of the LED light engine 10 is a projection 50 including a hole 52 formed therein. A fastener may be placed through the hole 52 in the projection 50 to affix the LED light engine 10 to a surface. Surrounding the insulated wires 12, 14 is a sealant material 70 which holds the insulated wires 12, 14 in place and acts as a strain relief 71, 72. The sealant material 70 both provides durability, protects the LED light engine 10 from moisture and holds the components of the LED light engine 10 together.

Figure 2:
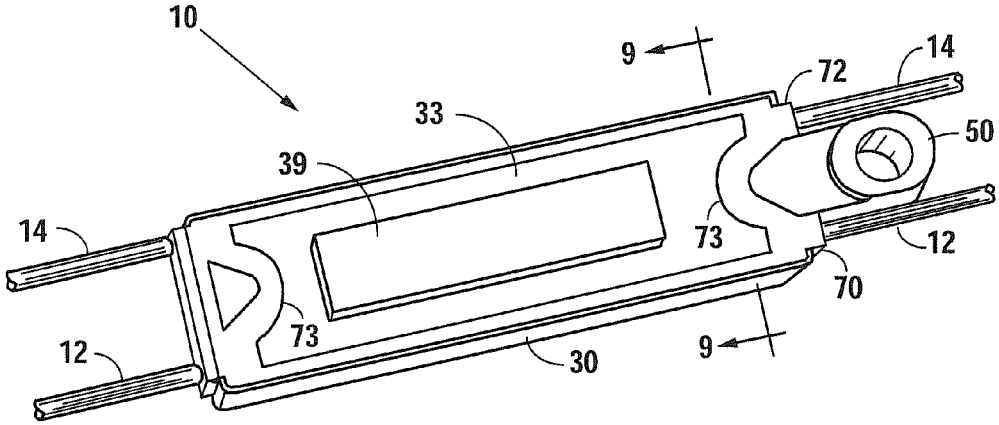
FIG. 2 is a bottom perspective of the completed light engine shown in FIG. 1.

The bottom of the LED light engine 10 is shown in FIG. 2. Therein the flat bottom surface 33 of the bottom enclosure 30 is shown. Optionally, two-sided tape 39 (FIG. 3) may be placed on the bottom surface 33 of the bottom enclosure 30. Use of the two-sided tape 39 provides another way of attaching the LED light engine 10 to a surface. Also shown on the bottom surface 33 of the bottom enclosure 36 are channels 73 filled with sealant material 70. This molten plastic sealant material 70 is contiguous with the strain relief 71, 72 formed around the insulated wires 12, 14 at both ends of the LED light engine 10.

Figure 3:
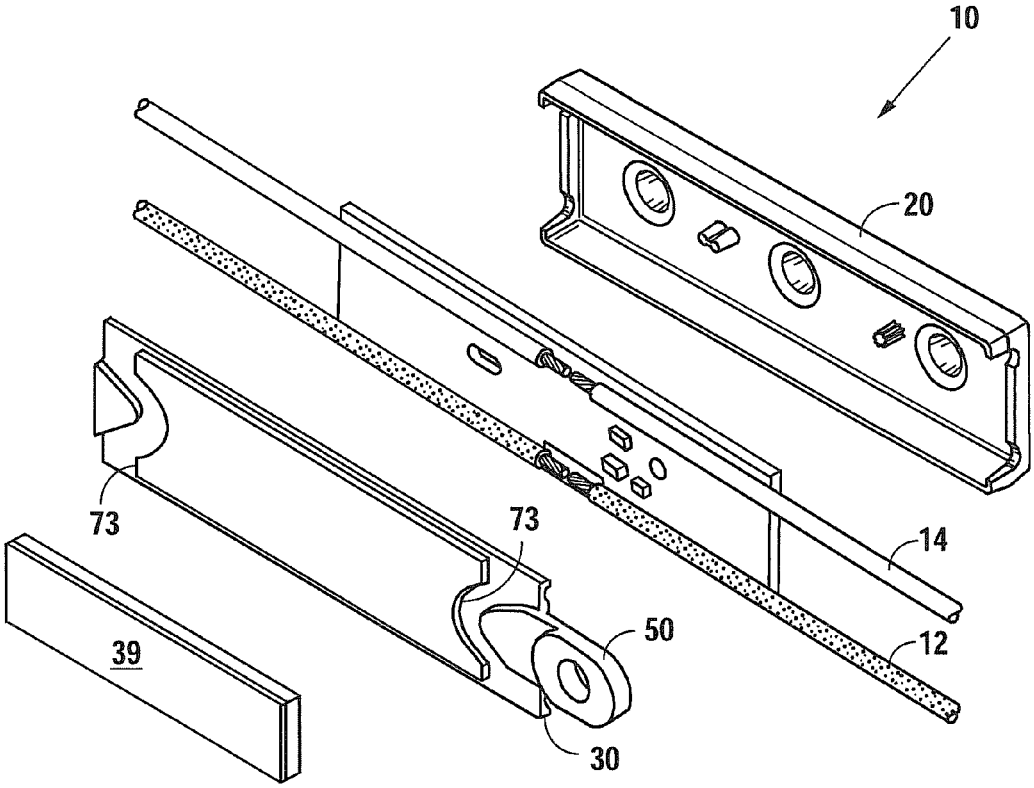
FIG. 3 is an exploded view of the light engine before the injection of the molten plastic sealant.
Figure 8:
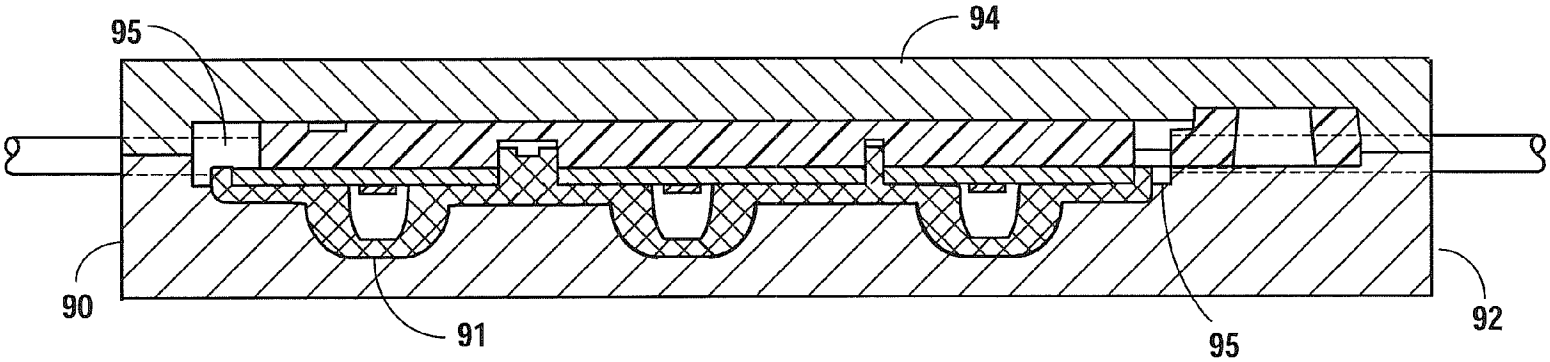
FIG. 8 is an elevational view in partial section of the assembled substantially U-shaped top enclosure, the printed circuit board and the bottom enclosure between the top and bottom of the mold in a plastic molding machine.

A still better understanding of the LED light engine 10 of the present invention may be had by reference to the exploded view shown in FIG. 3. Therein it may be seen that the printed circuit board 40 is effectively sandwiched between the substantially U-shaped top enclosure 20 and the bottom enclosure 30. The placement of the cooled sealant material 70 described above is not shown. As will be explained below, the substantially U-shaped top enclosure 20, the printed circuit board 40, and the bottom enclosure 30 are assembled one to another before the molten plastic sealant material 70 is injected therebetween. This combination of the substantially U-shaped top enclosure 20, the printed circuit board 40 and the bottom enclosure 30 is placed into a plastic mold (FIG. 8). Once in the plastic mold, the molten plastic sealant material 70 then flows into the openings between the substantially U-shaped top enclosure 20, the printed circuit board 40 and the bottom enclosure 30. When cooled, the molten plastic sealant 70 seals the LEDs 60 and electrical componentry 62 from damage by moisture, provides strain relief around the insulated wires 12, 14, holds the wires in place within the LED light engine 10 and affixes the substantially U-shaped top enclosure 20, the printed circuit board 40 and the bottom enclosure 30 one to another.

Figure 4A:
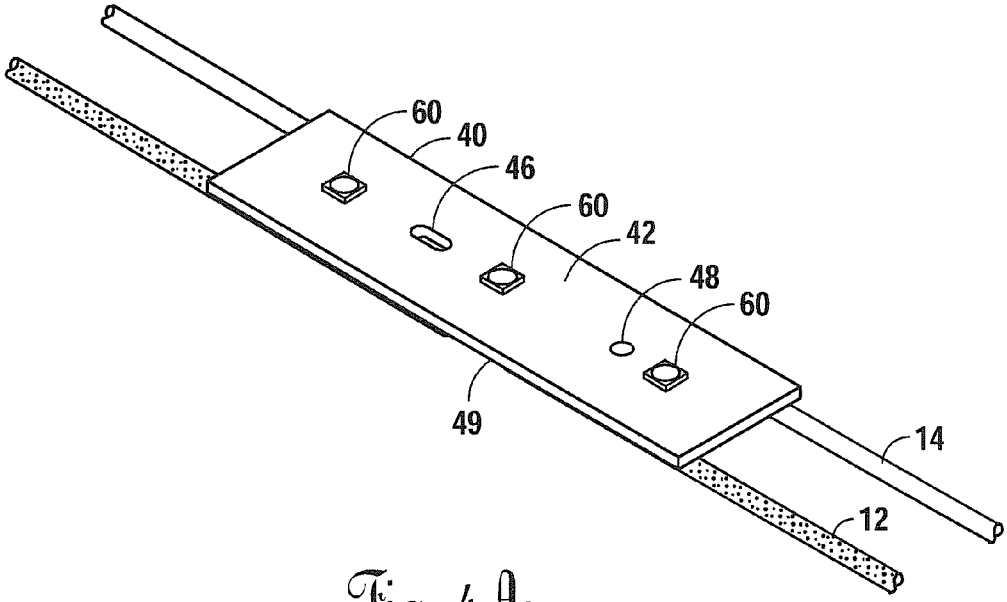
FIG. 4A is a top perspective view of the printed circuit board.

Shown in FIG. 4A is a top view of the printed circuit board 40. Note that three LEDs 60 are located on the top surface 42. While three LEDs 60 are shown in the preferred embodiment, the number of LEDs 60 located on the top surface 42 of the printed circuit board 40 is dependent on the application of the LED light engine 10 and the amount of light required. In the middle of the printed circuit board 40 is an alignment hole 48 and an alignment slot 46. While an alignment hole 48 and an alignment slot 46 are shown, those of ordinary skill in the art will understand that one or more holes or one or more slots may be used for alignment. Formed around the side of the printed circuit board is an edge 49.

Figure 4B:
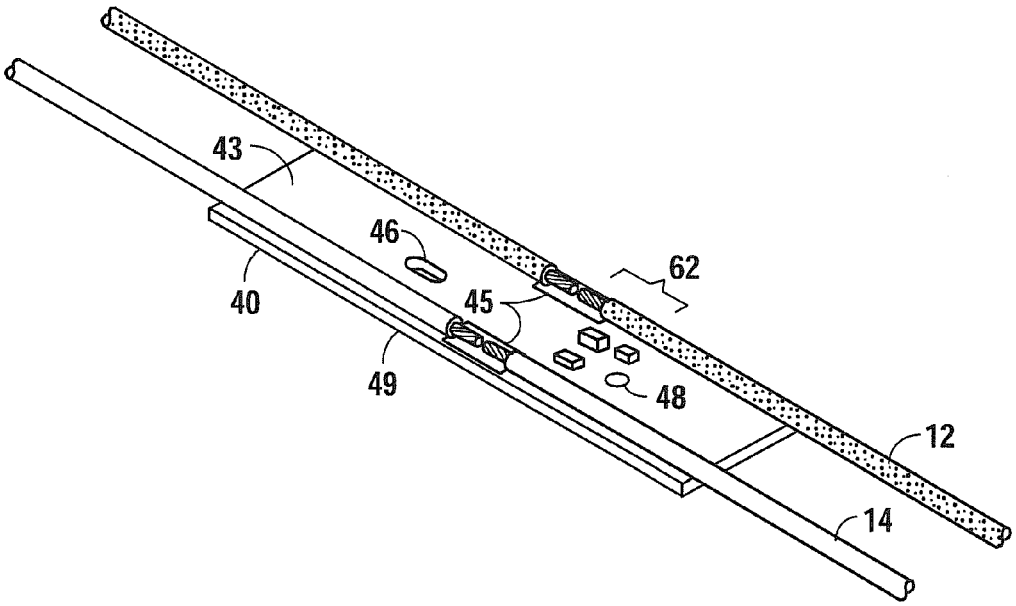
FIG. 4B is a bottom perspective view of the printed circuit board.

Shown in FIG. 4B is a bottom view of the printed circuit board 40. Note that various pieces of electronic componentry 62, to include resistors, diodes and integrated circuit chips, are located on the bottom 43 of the printed circuit board 40. Also located on the bottom 43 of the printed circuit board 40 are pads 45 onto which the metal wires contained within the insulation are soldered. Alternatively, a mechanical clamp-type connection may be used to attach the insulated wires 12, 14 to the bottom 43 of the printed circuit board 40. The alignment hole 48 and the alignment slot 46, as well as the edge 49 of the printed circuit board 40 described above appear in FIG. 4A.

Figure 5A:
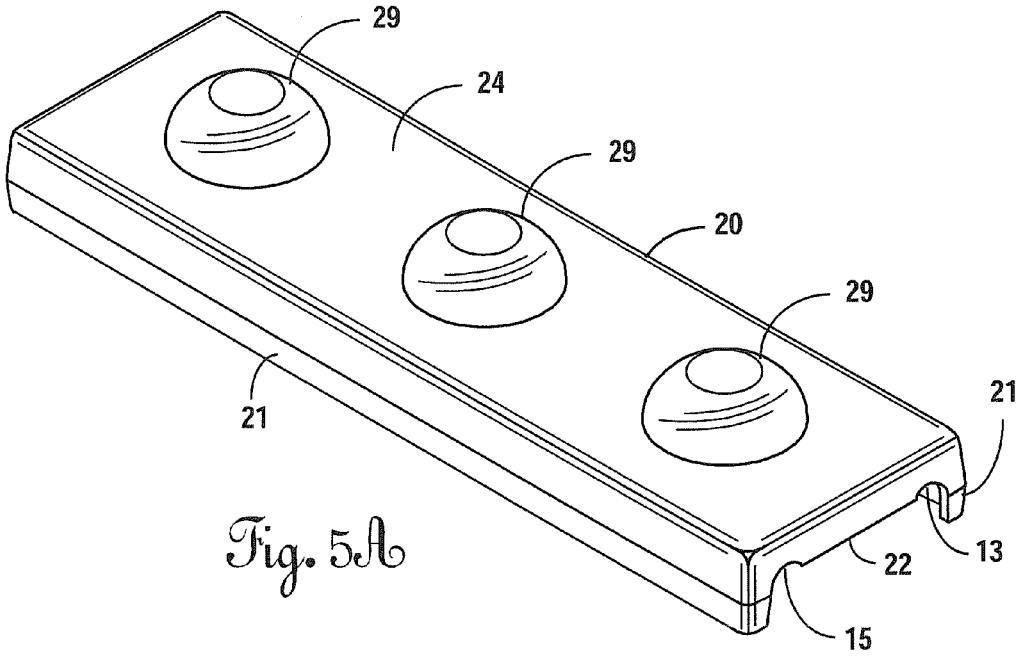
FIG. 5A is a top perspective view of the substantially U-shaped top enclosure.

A top view of the substantially U-shaped top enclosure 20 is shown in FIG. 5A. Therein it may be seen that lenses 29 are formed in the top surface 24 of the substantially U-shaped top enclosure 20. Each one of these lenses 29 is constructed, positioned and arranged to manage the light rays emitted by the LEDs 60. While three lenses 29 are shown in FIG. 5A, the number of lenses depends on the number of LEDs positioned on the top surface 42 of the printed circuit board 40. Also shown in FIG. 5A are the downwardly depending sides 21 which fit over the long edges 49 of the printed circuit board 40. At the ends of the substantially U-shaped top enclosure 20 are downwardly depending ends 22. The downwardly depending ends 22 include arcuate openings 13, 15 which assist in the placement of the insulated wires 12, 14 when the substantially U-shaped top enclosure 20, the printed circuit board 40 and the bottom enclosure 30 are assembled together.

Figure 5B:
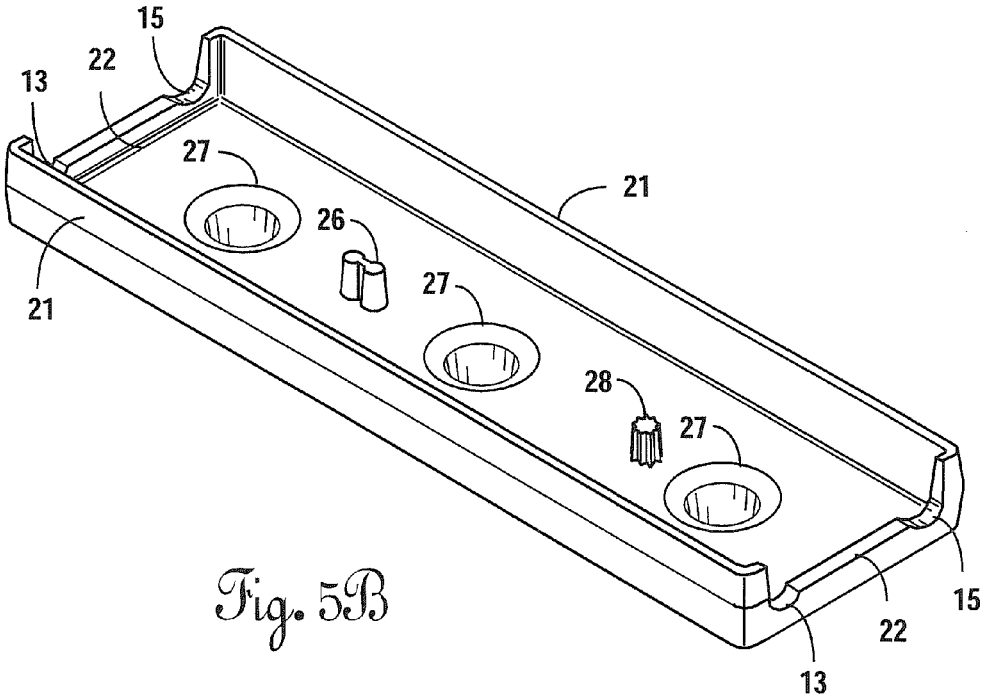
FIG. 5B is a bottom perspective view of the substantially U-shaped top enclosure.

Shown in FIG. 5B is a bottom view 23 of the substantially U-shaped top enclosure 20. Also visible are the lens openings 27. The lens openings 27 are positioned over each LED 60 by the alignment projections 26, 28 constructed, positioned and arranged to enter the alignment slot 46 and the alignment hole 48 formed in the printed circuit board 40. Between the inside surfaces of the downwardly depending sides 21, the downwardly depending ends 22, and around the lens openings 27 is a flat surface 23. As described below, a portion 19 of this flat surface 23 will eventually come into physical contact with the top surface 42 of the printed circuit board 40. It is anticipated that the substantially U-shaped top enclosure 20 will be made using a polymethyl acrylate ("PMMA") or a polycarbonate ("PC").

Figure 6A:
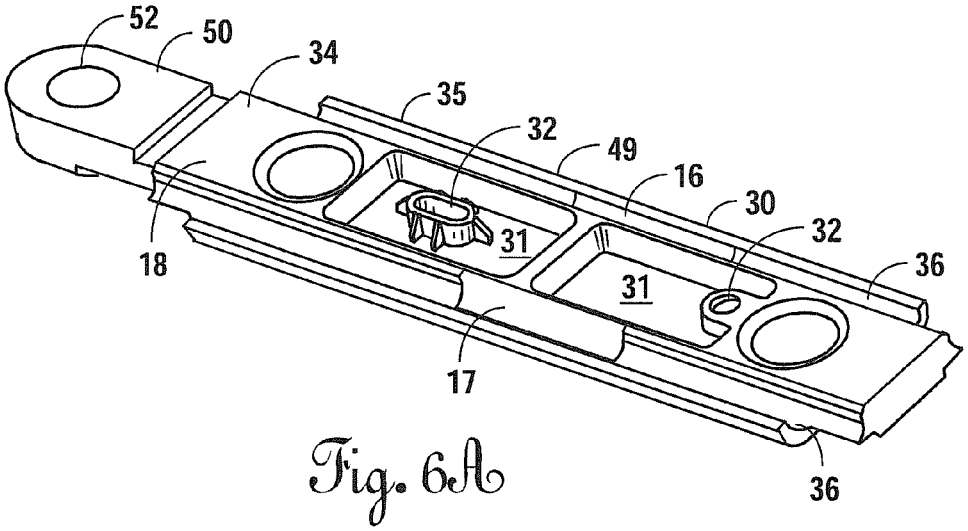
FIG. 6A is a top perspective view of the bottom enclosure.

Shown in FIG. 6A is a top view of the bottom enclosure 30. Along each long side 35 of the bottom enclosure 30 are channels 36. These channels 36 are sized to enable the position and the insertion of the insulated wires 12, 14 therein. Also shown in the top surface 34 of the bottom enclosure 30 are two wells 31. The rightmost well 31 in FIG. 6A is large enough to accommodate the electronic componentry 62 on the bottom 43 of the printed circuit board 40 (FIG. 4B). The wells 31 in FIG. 6A contain at least one alignment receptacle 32 into which the alignment projections 26, 28 formed in the bottom of the substantially U-shaped top enclosure 20 pass into after having passed through the alignment hole 48 and an alignment slot 46 formed in the printed circuit board 40. On one end of the bottom enclosure 30 is the projection 50 shown in FIG. 1. As described below, a portion 18 of top surface 34 will eventually come into physical contact with the bottom surface 43 of the printed circuit board 40.

Figure 6B:
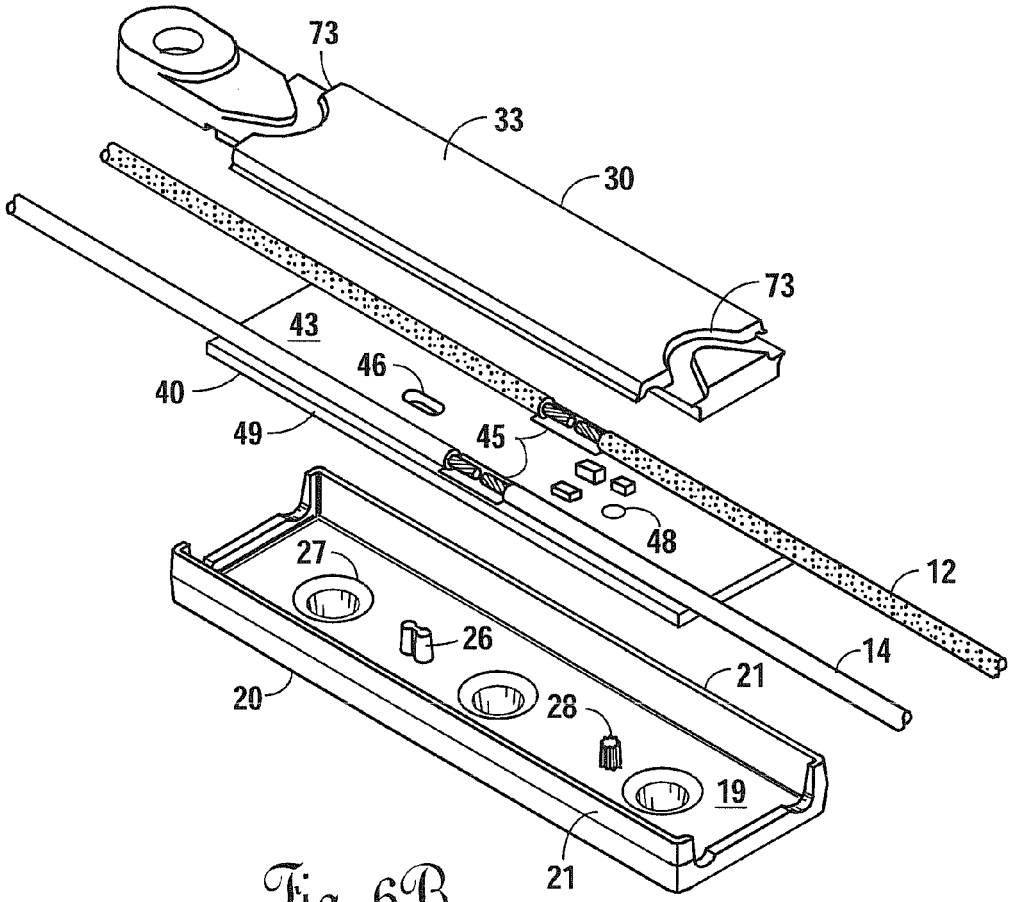
FIG. 6B is an exploded view of the pre-molding assembly of the printed circuit board between the bottom enclosure and the substantially U-shaped top enclosure.

Shown in FIG. 6B is the flat bottom surface 33 of the bottom enclosure 30. As noted above with respect to FIG. 3, the flat bottom surface 33 of the bottom enclosure 30 includes the channels 73 formed therein which will provide paths for the molten plastic sealant material 70 as shown in FIG. 2. It is anticipated that the bottom support enclosure 30 will be manufactured from PMMA, a polycarbonate, an ABS plastic, nylon or PVC.

Also shown in FIG. 6B is the initial step in the pre-molding assembly of the LED light engine 10. The first step is the insertion of the printed circuit board 40 between the downwardly depending sides 21 and into the substantially U-shaped top enclosure 20. The LEDs 60 align with the lenses 29, and the flat portion 19 of the top surface 24 of the substantially U-shaped enclosure 20 comes into physical contact with the top surface 42 of the printed circuit board 40. The LEDs 60 become aligned with the lenses 29 by the insertion of the alignment projections 26, 28 through the alignment hole 48 and alignment slot 46 in the printed circuit board 40.

The second step in the pre-molding assembly of the LED light engine 10 is the placement of the bottom enclosure 30 over the bottom 43 of the printed circuit board 40. Herein a portion of the bottom surface 18 (FIG. 6A) surrounding the wells 31 will come into physical contact the bottom 43 of the printed circuit board 40. As explained above, the electronic componentry 62 (FIG. 4B) will fit into the rightmost well 31 shown in FIG. 6A.

The tops of alignment projections 26, 28 from the bottom surface 23 of the substantially U-shaped top enclosure 20 will engage the alignment receptacles 32 positioned in each well 31 in FIG. 6A. The insulated wires 12, 14 will lie in the channels 36 formed on either side of the bottom enclosure 30. And, as shown in FIG. 6A, those portions of the insulated wires 12, 14, which are soldered to the bottom 43 of the printed circuit board 40, will fit within spaces 16, 17 formed on either side of the bottom enclosure 30.

Figure 7:
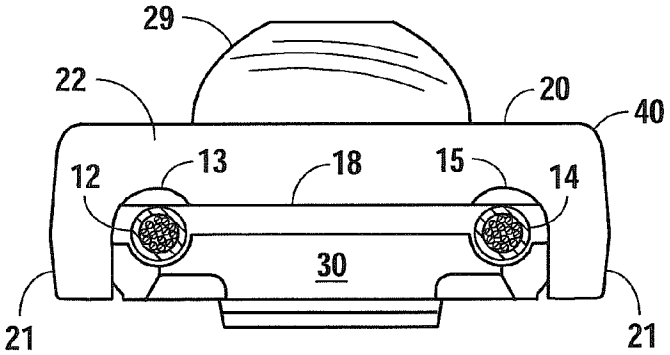
FIG. 7 is an end view in partial section of the assembled components before the injection of the molten plastic sealing material.

Shown in FIG. 7 is the end view of the assembled, but not yet molded, LED light engine 10. Portion 18 of the top surface 34 of the bottom enclosure 30 is placed against the bottom 43 of the printed circuit board 40. The edge 49 of the printed circuit board 40 is positioned within the insides of the downwardly dependent sides 21 of the substantially U-shaped top enclosure 20. The flat portion 19 of the bottom 23 of the substantially U-shaped top enclosure 20 is placed against the top surface 42 of the printed circuit board 40. The combination shown in FIG. 7 illustrates the openings available for the flow of molten sealant material 70 after the combination of the substantially U-shaped top enclosure 20, the printed circuit board 40 and the bottom enclosure 30 have been placed together.

As shown in FIG. 8, the openings 91 formed in the bottom 92 of the plastic mold 90 are sized to engage the lenses 29. When the top of the mold 94 and the bottom of the mold 92 are brought together, the molten sealant material 70 is injected into the combination of the assembled substantially U-shaped top enclosure 20, the printed circuit board 40 and bottom enclosure 30 as shown in FIG. 7. The molten sealant material 70 flows into the pathways formed when the top 94 and the bottom 92 of the plastic mold 90 are brought together. The molten sealant material 70 also fills the channels 36 in which the insulated wires 12, 14 are located. As may be seen in FIG. 9, a portion of the molten sealant material 70 flows inside the downwardly depending side 21 of the substantially U-shaped top enclosure 20 and chemically bonds with the inside of the depending side 21 of the substantially U-shaped top enclosure 20. The molten plastic sealant material 70 also bonds with the edges 49 of the printed circuit board 40. In addition, the molten plastic sealant material 70 also chemically bonds with the bottom enclosure 36 thereby affixing the substantially U-shaped top enclosure 20, the printed circuit board 40 and the bottom enclosure 30 one to another. The sealant material 70 does not flow over the top surface 42 of the printed circuit board 40.

At either end of the plastic mold 90, there is a space 95 surrounding the insulated wires 12, 14. The molten plastic sealant material 70 flows into this space around the outside of the insulated wires 12, 14. A chemical bond between the flowing plastic sealant material 70 and the insulation around the insulated wires 12, 14 is formed, thereby forming a strain relief 71, 72 section around the insulated wires 12, 14. The use of a plastic sealant material 70 also provides moisture resistance for the LEDs 60 and the electronic componentry 62 within the LED light engine 10.

Figure 9:
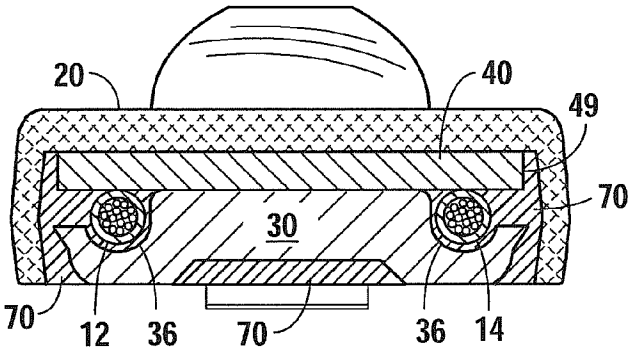
FIG. 9 is a cross-sectional view of the completed light engine at line 9-9 of FIG. 1 and of FIG. 2 showing the location of the cooled plastic sealant material.

The positioning of the cooled plastic sealant material 70 within the completed LED light engine 10 is best shown by reference to FIG. 9. Therein, it may be seen that the molten plastic sealant material 70 flows within the channels 36 and surrounds the insulated wires 12, 14.

While the projection 50 is shown as part of the bottom enclosure 30, those of ordinary skill in the art will understand that the projection 50 may be formed using the plastic sealant material 70 instead of having the projection 50 made a part of the bottom enclosure 30.

While the present invention has been described according to its preferred embodiment, those of ordinary skill in the art will understand that modifications to the preferred embodiment may be made without departing from the scope and meaning of the appended claims.

What is claimed is:

1. An LED light engine comprising:

a printed circuit board including:

a top surface on which is mounted at least one LED;

a bottom surface on which is mounted electronic componentry and insulated wires;

at least one alignment hole between said top surface and said bottom surface;

an edge surrounding said printed circuit board between said top and bottom surfaces;

a substantially U-shaped top enclosure including:

a top surface having at least one lens formed therein;

downwardly depending sides for surrounding said edge of said printed circuit board;

a bottom surface having at least one alignment piece constructed and arranged to pass through said at least one alignment hole in said printed circuit board;

a bottom enclosure including:

a top surface including at least one alignment receptacle formed therein and a pair of channels extending the length of said top surface;

said pair of channels constructed and arranged to position said insulated wires;

a sealant material enabling:

forming a strain relief around said insulated wires at either end of said substantially U-shaped top enclosure;

filling said pair of channels and said insulated wires positioned therein;

affixing said downwardly dependent sides of said substantially U-shaped top enclosure, said edge of said printed circuit board and said bottom enclosure one to another; and wherein the top of said printed circuit board is in direct physical contact with a portion of the bottom surface of said substantially U-shaped too enclosure and the bottom of said printed circuit board is in direct physical contact with a portion of the top surface of said bottom enclosure.

2. The LED light engine as defined in claim 1 further including a projection having a mounting hole formed therein, said projection extending from the end of said bottom enclosure.

3. The LED light engine as defined in claim 1 wherein said sealant material is not in contact with the top surface of said printed circuit board.

4. The LED light engine as defined in claim 2 wherein the projection having a hole formed therein and extending from the end of the bottom enclosure is formed by said sealant material.

5. A method for making an LED light engine comprising;

constructing a printed circuit board including:

a top surface on which is mounted at least one LED;

a bottom surface on which is mounted electronic componentry and insulated wire;

at least one alignment hole between said top surface and said bottom surface;

an edge between said top surface and said bottom surface;

constructing a substantially U-shaped top enclosure including:

a top surface having a number of lenses equal to the number of LEDs on said top surface of said printed circuit board;

downwardly depending sides for surrounding said edge of said printed circuit board;

a bottom surface having alignment pieces constructed and arranged to pass through said at least one alignment hole in said printed circuit board;

constructing a bottom enclosure including:

a top surface including at least one alignment receptacle formed therein and a pair of channels extending the length of said top surface, said pair of channels formed to position said insulated wires;

placing said printed circuit board between said downwardly dependent sides of said substantially U-shaped top enclosure and aligning it therewith by placing said at least one alignment hole over said at least one alignment piece;

placing said top of said bottom enclosure over the bottom of said printed circuit board and aligning it therewith by alignment of said at least one alignment receptacle with said alignment pieces on the bottom of said substantially U-shaped top enclosure;

placing said combination of said substantially U-shaped top enclosure, said printed circuit board and said bottom enclosure in a plastic mold;

injecting plastic sealant material into said combination of said substantially U-shaped top enclosure, said printed circuit board and said bottom enclosure enabling:

forming a strain relief around said insulated wires at either end of said substantially U-shaped top enclosure;

filling said pair channels and covering said insulated wires positioned therein;

affixing said downwardly dependent side of said substantially U-shaped top enclosure, said edge of said printed circuit board and said bottom enclosure one to another; and wherein the to of said printed circuit board is in direct physical contact with a portion of the bottom surface of said substantially U-shaped top enclosure and the bottom of said printed circuit board is in direct physical contact with a portion of the to surface of said bottom enclosure.

* * * * *